US006060693A

United States Patent [19]

Brown

[11] Patent Number: 6,060,693

[45] Date of Patent: May 9, 2000

[54] HEATING DEVICE FOR A GLOVE

[76] Inventor: Cameron Brown, 725 Forest Rd., Vail, Colo. 81657

[21] Appl. No.: 09/210,196

[22] Filed: Dec. 11, 1998

[51] Int. Cl.[7] ..... H05B 1/00

[52] U.S. Cl. ..... 219/211; 219/492; 219/494; 219/529; 219/549; 2/160; 2/163

[58] Field of Search ..... 219/202, 204, 219/211, 212, 492, 494, 529, 543, 549; 2/160, 163

[56] References Cited

U.S. PATENT DOCUMENTS

| | | | |
|---|---|---|---|
| 4,021,640 | 5/1977 | Gross et al. | 219/211 |
| 4,723,324 | 2/1988 | Lassiter | 2/160 |
| 4,727,602 | 3/1988 | Giese et al. | 2/163 |
| 4,764,665 | 8/1988 | Orban et al. | 219/549 |
| 4,825,039 | 4/1989 | Yoo | 219/212 |
| 4,950,868 | 8/1990 | Moss et al. | 219/211 |
| 5,541,388 | 7/1996 | Gadd | 219/211 |

*Primary Examiner*—Teresa Walberg
*Assistant Examiner*—Leonid Fastovsky
*Attorney, Agent, or Firm*—McAulay Nissen Goldberg Kiel & Hand, LLP

[57] ABSTRACT

A glove liner is provided with heating units placed at the fingertips to provide heat to the fingers. The heating units are encased in an electrically insulating material and wires which are covered with an electrically insulating and flexible material connect the heating units in series with a battery pack on the wrist of the wearer. The heating units and the wires are placed on the palm side of the lining and the heating units contact the fingers directly.

16 Claims, 4 Drawing Sheets

HEATING DEVICE FOR A GLOVE

BACKGROUND OF THE INVENTION

1. Field of the Invention

This invention relates to a heating device for a glove. More particularly, this invention relates to a heating device to be inserted in a skiing glove.

2. Description of the Prior Art

Heretofore, various types of heating devices have been applied to garments or other apparel as an added protection for a wearer of the garment against cold temperatures. These heating devices seek to add the comfort of additional heat without detracting from the aesthetic or functional qualities of the garment. The heating devices usually include a power supply such as a battery, to supply electrical energy to a coiled heating unit for heating purposes. In these cases, there are two competing considerations, namely, the power requirements of the heating device and the amount of heat provided by the heating device. The larger the power supply, the more power can be provided to the coiled heating unit and to the wearer. Conversely, the size of the power supply impacts the desirability of the heating device since larger power supplies will be heavier and more cumbersome to the wearer.

Independent of these two considerations is the concern of creating a heating device that will be able to withstand the natural movements of the body and not break with the stresses induced by the wearer's actions. Operation of a heating device depends on maintaining electrical connections between the power supply and the heating units as well as the integrity of the heating units themselves. Protecting the heating device often requires increasing the amount or thickness and rigidity of the material encasing the electrical connections to buffer against the bending and creasing of the hand. The additional material, however, decreases the flexibility and comfortability of the heating device.

As applied to garments to cover the hand, certain heating devices have emphasized different goals. For example, as described in U.S. Pat. No. 4,764,665, one prior art device has implemented a heating unit that spans the entire length of the hand. This construction is intended to supply uniform heat for the entire hand, but has a large power requirement. The heating device is also more prone to be broken with the movements of the hand since each crease and bend will subject the device to stress.

U.S. Pat. No. 4,021,640 describes a heating device which is intended to reduce the amount of area to be heated and thus the power required by heating only the fingertips of a user. The heating device employs heating units located at the fingertips and formed of resistance heating elements encased in plastic material. The connecting wires for the heating units are lined on the back of the hand and extend over the fingertips to the fingertip pads. Insulating strips separate the heating units and the corresponding wires from the skin. The insulating strips also protect the back of the hand from the external temperatures.

This construction, however, causes stress on the device and would be uncomfortable for the wearer. By extending the insulating strips over the back of the hand, the strips and the underlying wires must stretch with every bending of the hand and fingers along their respective joints. The stretching of the insulating material would cause the material to rub against the hand directly causing discomfort to the knuckles and finger nails of the hand. This rubbing will also restrict the movement of the hand. The heating units can also become displaced since the insulating strips are being stretched. The integrity of the electrical connections can become more easily broken with the stretching of the insulation strips and the underlying wires.

In addition, using plastic may also cause discomfort due to the "flare-up" of the plastic along the edges. This "flare-up" occurs when the material is bent in one direction. While the plasitc will bend in that direction, the edges of the crease will "flare-up" in the opposite direction of the bend in the material. These "flared-up" edges are relatively hard and inflexible which cause discomfort to the wearer and can distort the desired shape of the material.

SUMMARY OF THE INVENTION

Therefore, it is among the main objects of the invention to provide a heating device to be inserted into a glove or other apparel which uses a minimum of electrical power to provide an effective supply of heat to stimulate blood flow.

It is another object of the invention to be able to use a heating device in a skiing glove without impairing a comfortable fit of the glove on the hand of a skier and objects the hand comes in contact with, e.g. ski pole.

Briefly, the invention provides a heating device and method for providing heat to warm a gloved hand that uses a minimum of power.

The heating device employs a pliable support defining a plurality of spaced apart digitated elements corresponding to the fingers of a user and an opening between one of the elements and the remainder of the elements corresponding to the palm of a user. In addition, the pliable support is inwardly foldable about a fold axis passing through one of the remainder of the digitated elements of the support and the opening of the support.

The heating device also includes a plurality of electrical resistance heaters disposed at the distal end of the respective digitated element for heating a fingertip pad of a user and particularly the nerve sensors in the fingertip pads. Still further, the heating device employs an electrical circuit which includes a plurality of wires which are electrically connected to the heaters in order to deliver an electrical current thereto. As is known, the finger tips are the most sensitive area of a human hand. By providing heat to the fingertips alone, the increased sensations at the fingertips will be felt throughout the entire hand.

Providing heat at the fingertips to warm the entire hand also takes advantage of the fact that the fingertips are the first portion of the hand that become affected physiologically by a cold temperature. Cold temperature typically constricts the blood vessels and reduces the amount of heat furnished internally to the hand. This constriction occurs first at the fingertips since the fingertips are first exposed to the colder temperature. When the fingertips are warmed to a certain temperature, the blood vessels do not constrict and normal heat to the hand is maintained through blood flow.

Another advantage of placing the heating units at the fingertips is that the heating units are less prone to breaking. Restricted to the fingertips alone, the heating units are not subjected to the normal wear and tear of bending with the joints of the fingers and natural creases of the hand.

By lining the wires that connect the heating pads to a power source on the palm side of the hand, the wires are not required to stretch with each bend of the hand, but rather solely needs to bend with the hand. This position protects the integrity of the electrical circuit and decreases the likelihood of the heating units being displaced from the fingertip pads.

The electrical circuit of the heating device can also have a terminal electrically connected to the wires which is adapted for selective engagement with a battery pack.

The heating device is particularly useful for a glove having a plurality of finger-receiving sleeves projecting from a palm. In this case, the spaced apart elements of the pliable support of the heating device in the finger-receiving sleeves are on the palm side so that the support for the heating devices is inwardly foldable about a fold line passing through one of the sleeves and the palm.

The battery pack which is used with the heating device is of relatively small size compared to previously known battery packs. For example, the battery pack may include a plurality of batteries for delivering 2.4 volts.

A switch may also be provided with the battery pack or the heating device in order to de-energize the battery pack relative to the heating device. Thus, when there is no need to heat the fingers of a gloved hand, the switch is in an off position.

The support of the heating device may be made of any suitable material. However, silicon has been found to be a preferred material since the material is most flexible and provides a good "feel" to the user. Likewise, the glove may be made of any suitable material such as a Spandex Lycra material.

DETAILED DESCRIPTION OF THE INVENTION

Figure 1:
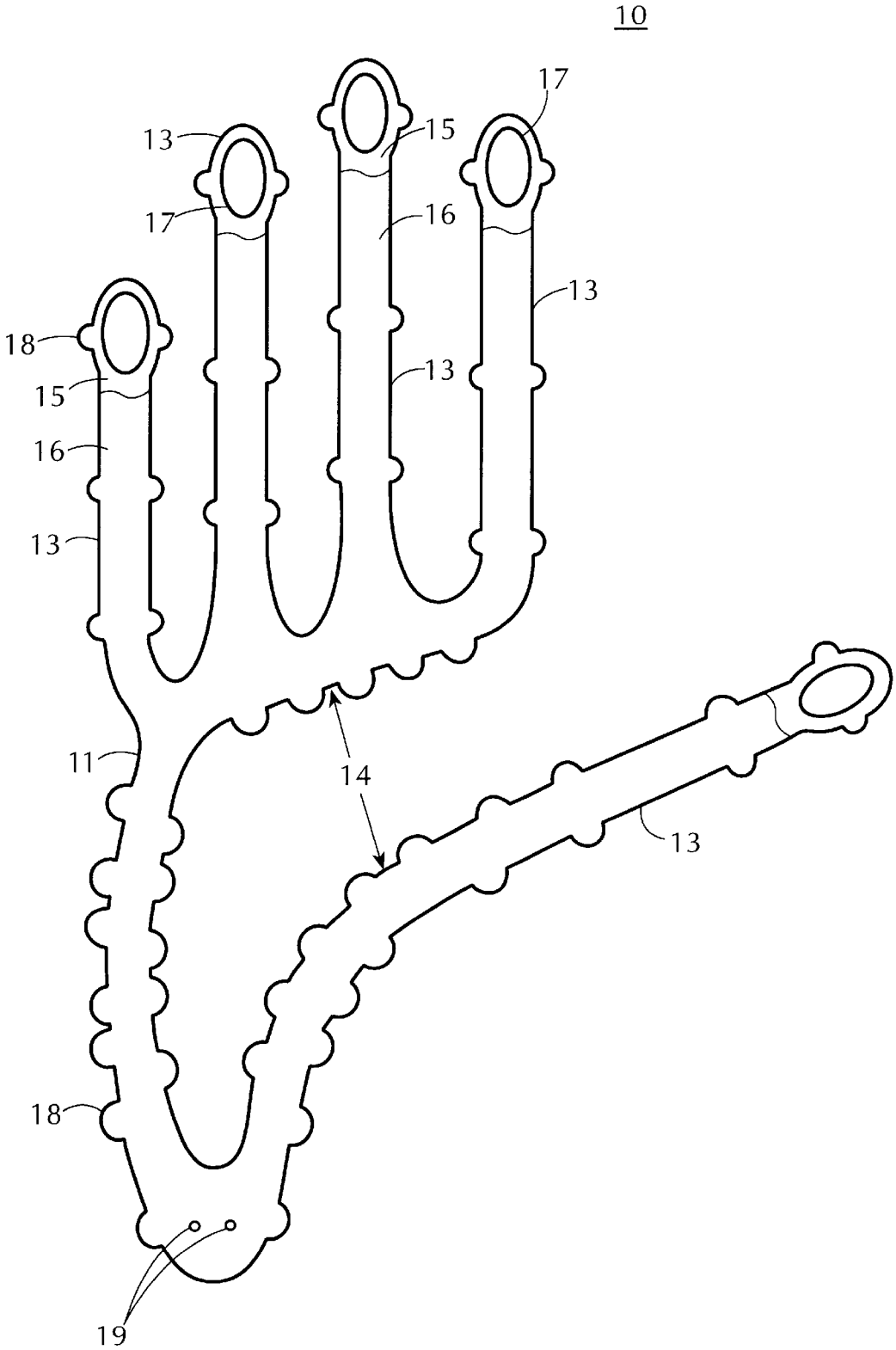
FIG. 1 is a view of a heating device constructed in accordance with the invention.

Referring to FIG. 1, the heating device 10 includes a multi-layered pliable support 11 which defines a plurality of spaced apart digitated elements 13 i.e. five-corresponding to the fingers of a user or the finger receiving sleeves of a glove as well as an opening 14 between one of the elements such as the element corresponding to the thumb of the user and the remainder of the elements which correspond to the fingers of the user. In addition, the opening 14 corresponds to the palm of a user.

The support 11 is inwardly foldable about a fold axis which passes through one of the digitated elements 13 and the opening 14. The heating device 10 also includes a plurality of electrical resistance heaters 17 disposed between two layers 15, 16 of the support 11. Each heater 17 is disposed at a distal end of a respective element for heating a fingertip pad of a user. Tabs 18 can extend from the ends of the digitated elements 13 of the support 11 which are used to attach the support 11 to the fabric of a glove.

Figure 2:
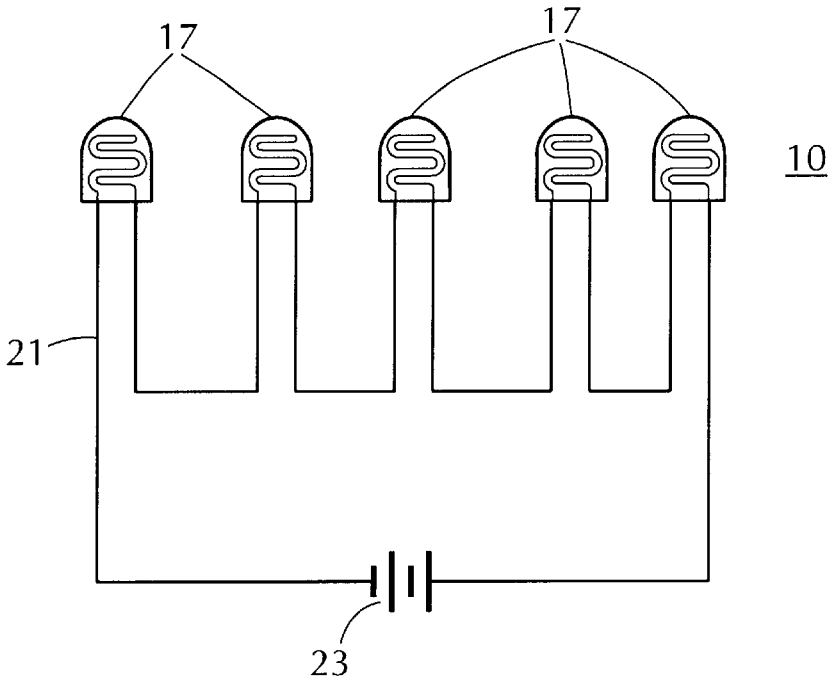
FIG. 2 is a schematic drawing of a heating circuit constructed in accordance with the invention.

Referring to FIG. 2, the heating device 10 also employs an electrical circuit which includes a plurality of wires 21 between two layers of the support (not shown) which are electrically connected to the heaters 17 in order to deliver an electrical current thereto. The heaters are electrically connected to the wires 21 in series with the power source 23.

As shown in FIG. 1, the support 11 is provided with a terminal 19 at the base of the support 11 to which the wires 21 of the electircal circuit on the support 11 are connected. Additional electrically conductive wires (not shown) connect the terminal 19 to the power source 23 (FIG. 2) via an on/off switch (not shown).

Referring to FIG. 1, the pliable support is made of a pair of layers 15, 16, for example, silicon material, between which the heater element 17 is sandwiched. Likewise, the electrical wires are also sandwiched between the layers 15, 16 of the support 11 and extend to the terminal 19. As is known, the blood vessels of the fingers will expand as higher temperatures are sensed by the nerves of the fingers. For example, a temperature of approximately 40° to 45° C. will cause the blood vessels to expand and thus increase the blood flow. Having a total series resistance of 1.9 Ω and 0.594 watts per heater element has been found to generate sufficient heat to the fingertips to provide comfort to the wearer.

Figure 3:
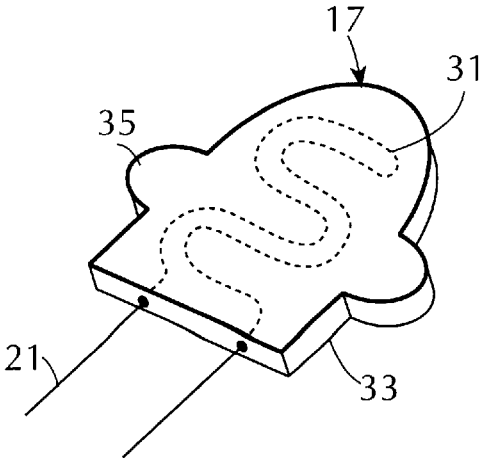
FIG. 3 is a detailed view of an electrical resistance heater in accordance with the invention.

As depicted in FIG. 3, each heating unit 17 includes a single heating element 31 and is typically a resistance type heating element. The heating element 31 is encased in a material 33 which serves to electrically isolate the wearer's skin from the heating elements 17 and defines the area through which heat is provided to the wearer. The wires 21 are attached to the heating element 31 at the base of the encasing material 33. The wires 21 are covered with insulating material that is flexible enough to allow the wires 21 to bend with the hand and not be broken. The encasing material 33 can be provided with flaps 35 to allow the heating units 17 to be directly attached to a glove lining. Typically, the encasing material 33 is composed of a flexible and durable material to withstand the wearer's motion especially during extensive exercise activity.

Figure 4:
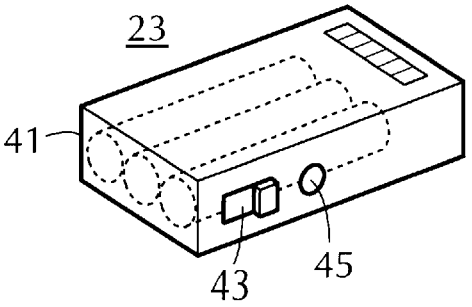
FIG. 4 is a detailed drawing of a power pack useable with the heating device.

As depicted in FIG. 4, the power source 23 can consist of a battery pack 41 having AA size batteries and is sufficiently light in weight to not encumber the wearer. Additional modifications of the battery pack 41 can include a switch 43 to turn the heating device on and off and a LED 45 to indicate when heat is being provided. The switch 43 can be a simply on/off switch or can even incorporate a variable switch. Each modification must be chosen with the desired goal of not encumbering the wearer.

Figure 5:
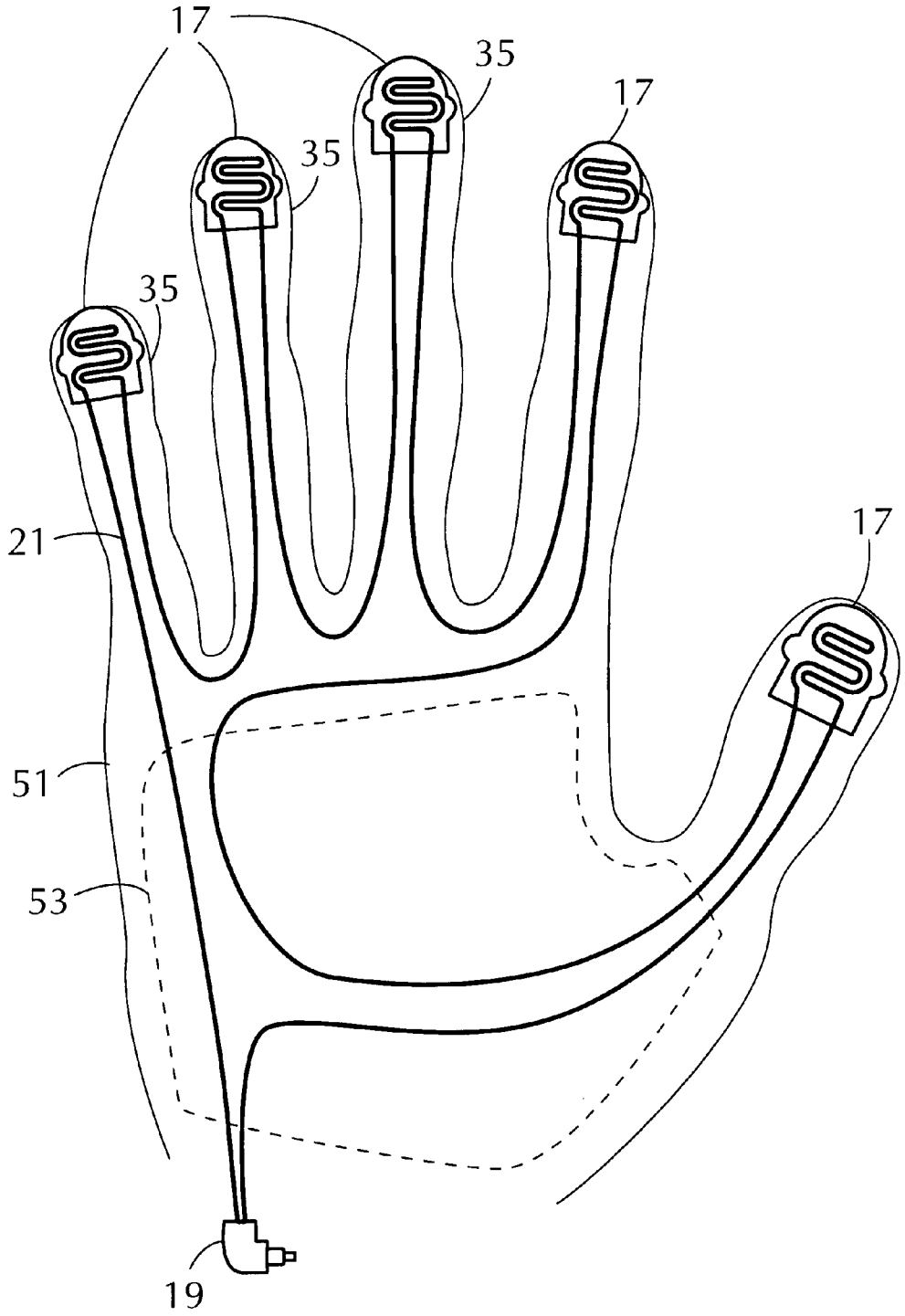
FIG. 5 is an alternative embodiment of a heating device constructed in accordance with the invention.

Referring to FIG. 5, wherein like references characters indicate like parts, as above, in an alternative embodiment, the heating units 17 may be stitched into a glove lining 51 through flaps 35 located on the heating units 17. The glove lining 51 should be composed of a light material to avoid adding more bulk to the glove. Additionally, the wires 21 are stitched into the glove lining 51 on the palm side of the hand by stitching 53. Stitching 53 can incorporate an additional fabric to secure the wires 21 to the glove lining 51. Each heating unit 17 is composed of an etched foil which is able to provide uniform heat throughout the desired area.

Figure 6:
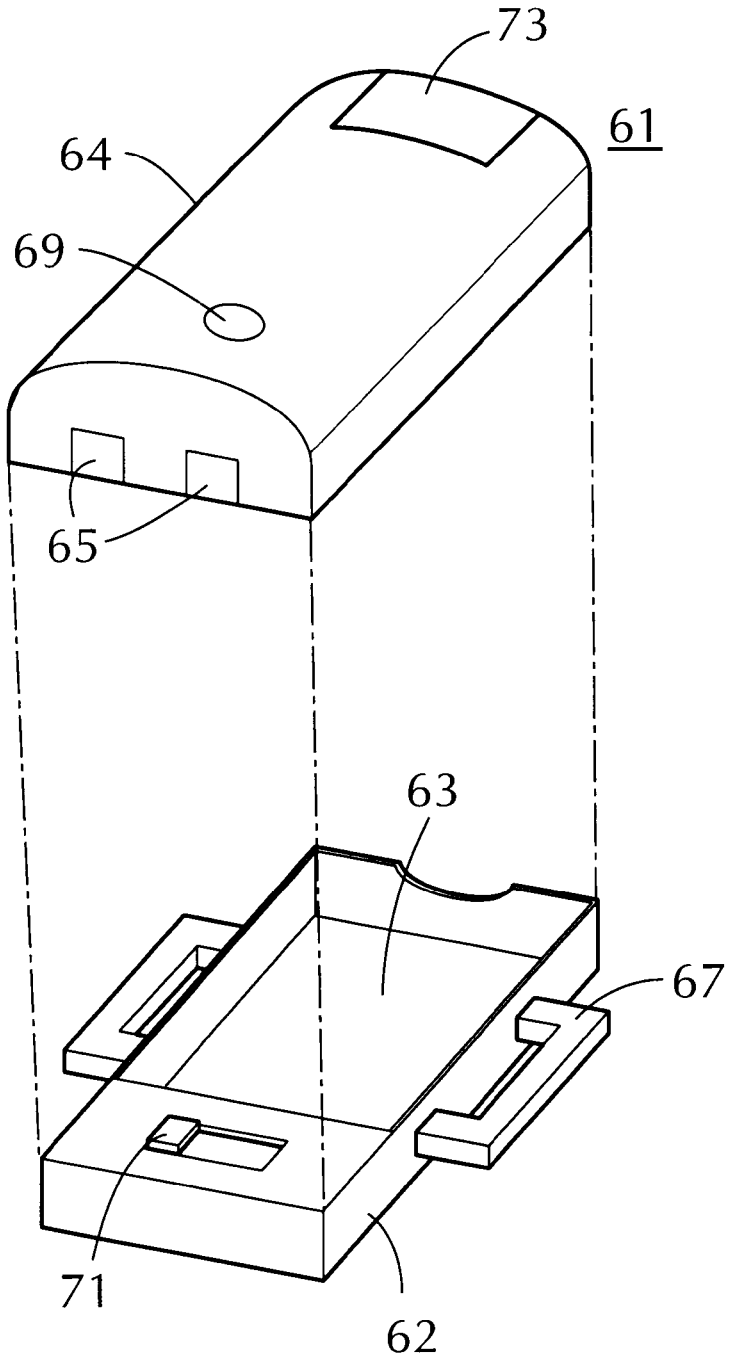
FIG. 6 depicts a modular embodiment for the power pack.

As depicted in FIG. 6, a modular battery pack may be used to increase the facility and comfort to the wearer. As shown, the battery pack 61 is formed of a two piece housing with the lower housing half 62 forming a docking bay 63 to receive batteries (not shown) and the upper housing half 64 having contact tabs 65 to provide electrical connections from the batteries to the heating circuit. Handles 67 are provided on the lower housing half 62 to allow the battery pack 61 to be strapped to the wrist and LED 69 and on/off switch 71 are located on the respective housing halves 62, 64 to show when the battery pack 61 is energized and to allow for an on/off operation, respectively. Release tab 73 is provided on the upper housing half 64 to provide for disengagement of the two housing halves 62, 64 from each other to gain access to the docking bay 63.

The invention thus provides a heating device which can be readily incorporated in a glove, such as a ski glove, without interfering with the use of the glove or the comfort of the wearer. The invention also provides a heating device which is capable of a long life as flexing of the components of the heating device is very limited during normal use.

Still further, the invention provides a heating device for a glove which is capable of supplying a relatively large amount of heat at a lower power output.

The invention further provides a heating device which can readily withstand the natural movements of a hand and particularly natural movements of the hand when coming into contact with other elements such as ski poles and the like.

What is claimed is:

1. A heating device for a glove comprising:

a pliable support defining a plurality of spaced apart digitated elements corresponding to the fingers of a user and an opening between one of said elements and the remainder of said elements and corresponding to the palm of a user; said support being inwardly foldable about a longitudinal axis passing through one of said remainder of said elements and said opening;

a plurality of electrical resistance heaters, each heater being disposed at a distal end of a respective element for heating a fingertip pad of a user; and an electrical circuit including a plurality of wires electrically connected to said heaters to deliver an electrical current thereto.

2. A heating device as set forth in claim 1 wherein said electrical circuit has a terminal electrically connected to said wires and adapted for selective engagement with a battery pack.

3. A heating device as set forth in claim 2 wherein said heaters are electrically connected to said wires in series.

4. A heating device as set forth in claim 1 wherein said support is of multi-layered construction with each layer made of silicone, said heaters and said wires being disposed between two of said layers.

5. In combination a glove having a palm on one side, and a plurality of finger-receiving sleeves projecting from said palm; and a heating device mounted in said glove, said heating device including a pliable support in said glove and having a plurality of spaced apart elements disposed in said sleeves on said one side, said support being inwardly foldable about a fold axis passing through one of said sleeves and said palm.

6. The combination as set forth in claim 5 wherein said heating device includes a plurality of electrical resistance heaters, each heater being disposed at a distal end of a respective element for heating a fingertip pad of a user in a respective sleeve of said glove.

7. The combination as set forth in claim 6 wherein said heating device has a plurality of wires electrically connected to said heaters to deliver an electrical current thereto.

8. The combination as set forth in claim 7 wherein said electrical circuit has a terminal electrically connected to said wires and adapted for selective engagement with a battery pack.

9. The combination as set forth in claim 8 wherein said heaters are electrically connected to said wires in series.

10. The combination as set forth in claim 7 further comprising a battery pack removably mounted on said glove and wherein said heating device includes a terminal electrically connected to said wires and removably connected to said battery pack.

11. The combination as set forth in claim 10 wherein said battery pack includes a plurality of batteries for delivering 2.4 volts.

12. The combination as set forth in claim 10 wherein one said battery pack and said heating device includes a switch to deenergize said battery pack relative to said heating device.

13. A heating device as set forth in claim 1 wherein said support has five of said digitated elements and said opening is disposed between one of said digitated elements corresponding to a thumb of a user and the remainder of said digitated elements.

14. A heating device as set forth in claim 1 wherein said support has five of said digitated elements disposed between one of said digitated elements corresponding to a thumb of a user and the remainder of said digitated elements.

15. The combination as set forth in claim 5 wherein said glove has five finger-receiving sleeves and said pliable support has five of said elements, each said element being disposed in a respective sleeve.

16. The combination as set forth in claim 15 wherein said support has an opening dispoed between one of said elements corresponding to a thumb of a user and the remainder of said elements.

* * * * *

UNITED STATES PATENT AND TRADEMARK OFFICE

CERTIFICATE OF CORRECTION

PATENT NO. : 6,060,693

DATED : May 9, 2000

INVENTOR(S) : Heating Device for a Glove

It is certified that error appears in the above-identified patent and that said Letters Patent is hereby corrected as shown below:

Column 2, line 38 change "pads" to -pad-

Column 4, line 42 change "simply" to -simple-

Column 6, line 27 after "one" insert -of-
Line 36 change "claim 1" to -claim 5-
Line 37 after "elements" insert -and said opening is-
Line 45 change "dispoed" to -disposed- Signed and Sealed this Twenty-seventh Day of February, 2001

Nicholas P. Godici

*Attest:*

NICHOLAS P. GODICI

*Attesting Officer*

*Acting Director of the United States Patent and Trademark Office*